United States Patent [19]

Knudson

[11] Patent Number: 5,038,592

[45] Date of Patent: Aug. 13, 1991

[54] APPARATUS FOR MAKING SIDING FOR BUILDINGS AND THE LIKE

[76] Inventor: Gary A. Knudson, 17356 W. 57th Ave., Golden, Colo. 80401

[21] Appl. No.: 512,378

[22] Filed: Apr. 23, 1990

[51] Int. Cl.[5] ..... B21D 5/14

[52] U.S. Cl. ..... 72/181; 72/226; 72/237

[58] Field of Search ..... 72/179–181, 72/176, 164, 248, 246, 226, 237

[56] References Cited

U.S. PATENT DOCUMENTS

| | | | |
|---|---|---|---|
| 2,176,115 | 10/1939 | Yoder | 72/181 |
| 2,213,507 | 9/1940 | Ungerer | 72/164 |
| 2,288,119 | 6/1942 | Weightman | 72/181 |
| 3,710,607 | 1/1973 | Beymer | 72/176 |
| 3,788,115 | 1/1974 | Beymer | 72/181 |
| 3,791,185 | 2/1974 | Knudson | 72/181 |
| 4,020,666 | 5/1977 | Beymer | 72/181 |
| 4,411,146 | 10/1983 | Sulasaari | 72/181 |
| 4,724,695 | 2/1988 | Stoehr | 72/226 |
| 4,787,233 | 11/1988 | Beymer | 72/181 |
| 4,899,566 | 2/1990 | Knudson | 72/181 |

FOREIGN PATENT DOCUMENTS

| | | | |
|---|---|---|---|
| 100826 | 8/1980 | Japan | 72/181 |
| 97719 | 6/1984 | Japan | 72/164 |
| 74730 | 4/1986 | Japan | 72/164 |
| 1206018 | 9/1970 | United Kingdom | 72/164 |

*Primary Examiner*—Daniel C. Crane

*Attorney, Agent, or Firm*—Fields, Lewis, Pittenger & Rost

[57] ABSTRACT

Apparatus for making different residential and commercial building siding of different widths includes a series of roller stations with selective vertical roller positioning adjustments and selective axial lateral roller portion position adjustments. An optional embossing station provides wood graining. A rotary punch forms the holes in a formed one piece nail strip siding.

16 Claims, 8 Drawing Sheets

STATIONS 7
93
91
5
89
8
1
81
82
21
83
M
90
87
94
84
86
88
4
85
22
6

6
21
99
83
94
M
104
86
22
108
109

99
94
97
81
127
98
126
83
124
123
125
M
104
109
86
107
108
105
84
106

APPARATUS FOR MAKING SIDING FOR BUILDINGS AND THE LIKE

TECHNICAL FIELD

This invention relates to a novel and improved apparatus for making shaped panel members and particularly apparatus for making siding of different configurations, different widths, and different edge fastenings using the same machine.

BACKGROUND ART

Siding for buildings is commonly used in residential and commercial building construction. This siding has heretofore been made from sheet metal coil stock using roll-forming apparatus. Some of the different configurations or shapes of building siding presently in use are commonly referred to as the colonial, horizontal double four, horizontal double five, vertical board and batten, vertical double four, vertical double five and colonial dutch lap.

Knudson U.S. Pat. No. 3,791,185 discloses apparatus for forming siding for buildings wherein the lower of each pair of a group of pairs of rollers are dropped down so that the same apparatus may be used to form different siding shapes.

Knudson U.S. Pat. No. 4,899,566 discloses pairs of rollers in roll-forming apparatus having lateral adjustments of the rollers in each pair to form shaped panels having different panel widths from the same rollers.

Beymer U.S. Pat. Nos. 3,710,607, 3,788,115, 4,020,666 and 4,787,233 disclose machines for roll forming siding from sheet material using a series of roll-forming stations.

DISCLOSURE OF THE INVENTION

Apparatus for making siding disclosed includes a series of roller stations with each station having opposed pairs of upper and lower rollers between which a sheet material is successively passed. The first station includes a rotary punch with a plurality of circumferentially spaced punch blades on one roller portion and a circumferential slot and a movable ring in the slot on an opposite roller portion which co-operate to form a series of slots in the material for making a nail strip siding. The second optional station has a pair of embossing rollers shaped to provide a wood-like grain in the sheet material so the siding will resemble wood. One of these embossing rollers moves between either a shaping or non-shaping position so that providing the grain is optional. The third through ninth stations form the connecting flanges along opposite side edges. These stations have roller lateral adjustment to form the flanges for two different siding widths. The tenth through nineteenth stations have a lever-cam conversion system which enables selected pairs of opposed rollers to be moved between either a shaping position or a spread non-shaping position which allows the material to pass freely therebetween. The lever-cam conversion system together with roller lateral adjustment forms siding of several different configurations in two different widths.

BRIEF DESCRIPTION OF THE DRAWINGS

Details of this invention are described in connection with the accompanying drawings which like parts bear similar reference numerals in which.

DETAILED DESCRIPTION

Figures 1, 2, 3:
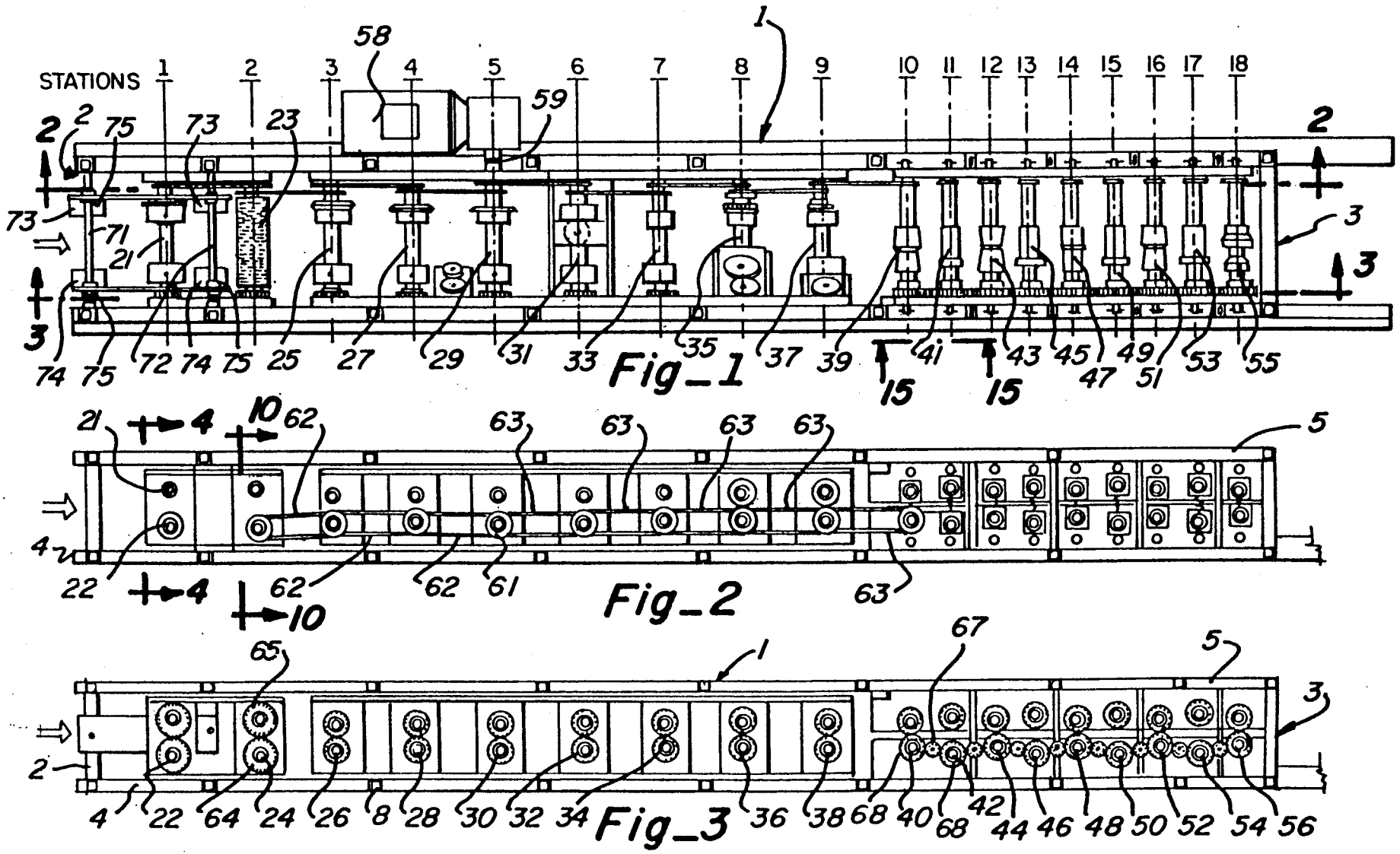
FIG. 1 is a top plan view of apparatus for making siding embodying features of the present invention with a top portion of the frame removed to view interior parts.
FIG. 2 is a sectional view taken along line 2—2 of FIG. 1.
FIG. 3 is a sectional view taken along line 3—3 of FIG. 1.

Referring now to drawings the apparatus for making siding shown has a support frame 1 with a feed or entry end 2 and a discharge or exit end 3. The support frame 1 is in the form of a three-dimensional oblong open framework which includes a pair of laterally spaced, longitudinally extending bottom frame members 4, a pair of laterally spaced, longitudinally extending top frame members 5, spaced transverse bottom frame members 6 connected at the ends to members 4, spaced transverse top frame members 7 connected at the ends to members 5, and spaced upright side frame members 8 connected at the ends to associated top and bottom longitudinal frame members. These frame members shown are preferably tubular steel.

Within the support frame 1 there are eighteen roller stations generally designated by numerals 1 to 18. Each station has an upper roller and a lower roller between which a sheet material is passed. Each roller has a shaft suitably journaled for rotation in bearings in laterally spaced side members at opposite ends of the shaft. For reference purposes the upper and lower rollers of each pair proceeding from the feed end toward the discharge end are designated as 21 and 22, respectively, at station 1, upper roller 23 and lower roller 24 at station 2 with succeeding numbers 25 through 54 at succeeding respective stations 3 through 18 with station 18 having an upper roller 55 and a lower roller 56.

Figure 10:
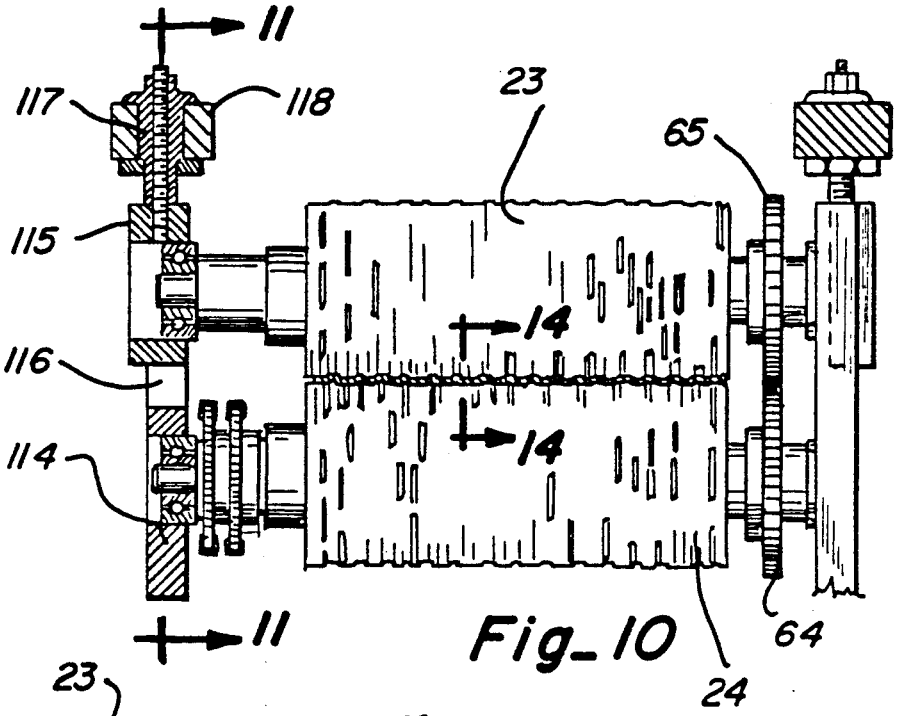
FIG. 10 is a sectional view taken along lines 10—10 of FIG. 1 at station 2 showing the embossing rollers.
Figure 14:
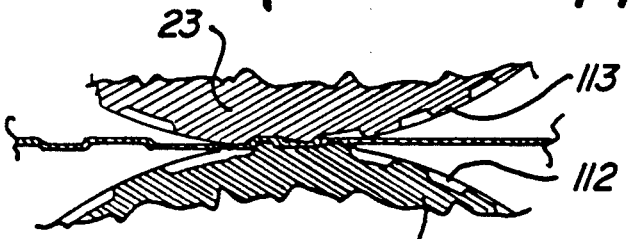
FIG. 14 is a sectional view taken along lines 14—14 of FIG. 10.
Figure 11:
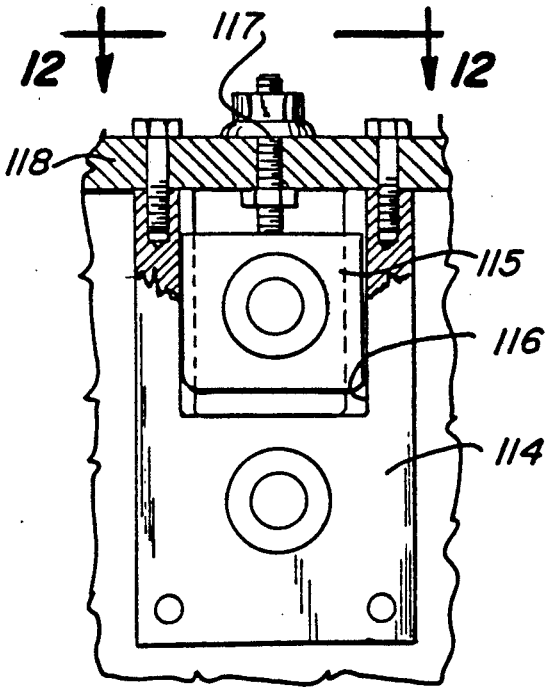
FIG. 11 is a sectional view taken along line 11—11 showing the left side of station 2.
Figure 12:
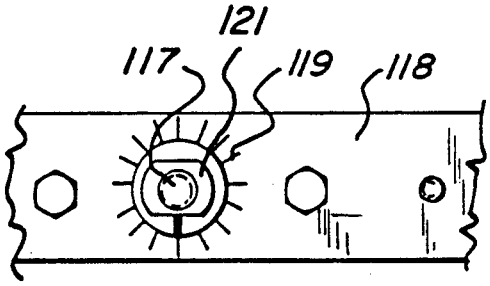
FIG. 12 is a top plan view taken along line 12—12 of FIG. 11 showing the increments for the adjustment nut.

The motor or prime mover 58 for rotating the rollers shown is a right angle electric gear motor having an output shaft 59 directly coupled to the shaft of the lower roller 30 of station 5. As seen in FIG. 2 a chain sprocket 61 on the lower shaft at station 5 couples power back via three chains 62, back to associated chain sprockets on the lower shafts at stations 4, 3, and 2 and couples power forward via five chains 63 to chain sprockets on the lower shafts at stations 6, 7, 8, 9 and 10. With the exception of station 1 which is not power driven, as seen in FIGS. 3 and 10, each lower shaft has a lower gear 64 on each lower shaft meshing with an upper gear 65 on the upper shaft to positively drive each associated upper shaft.

Figure 15:
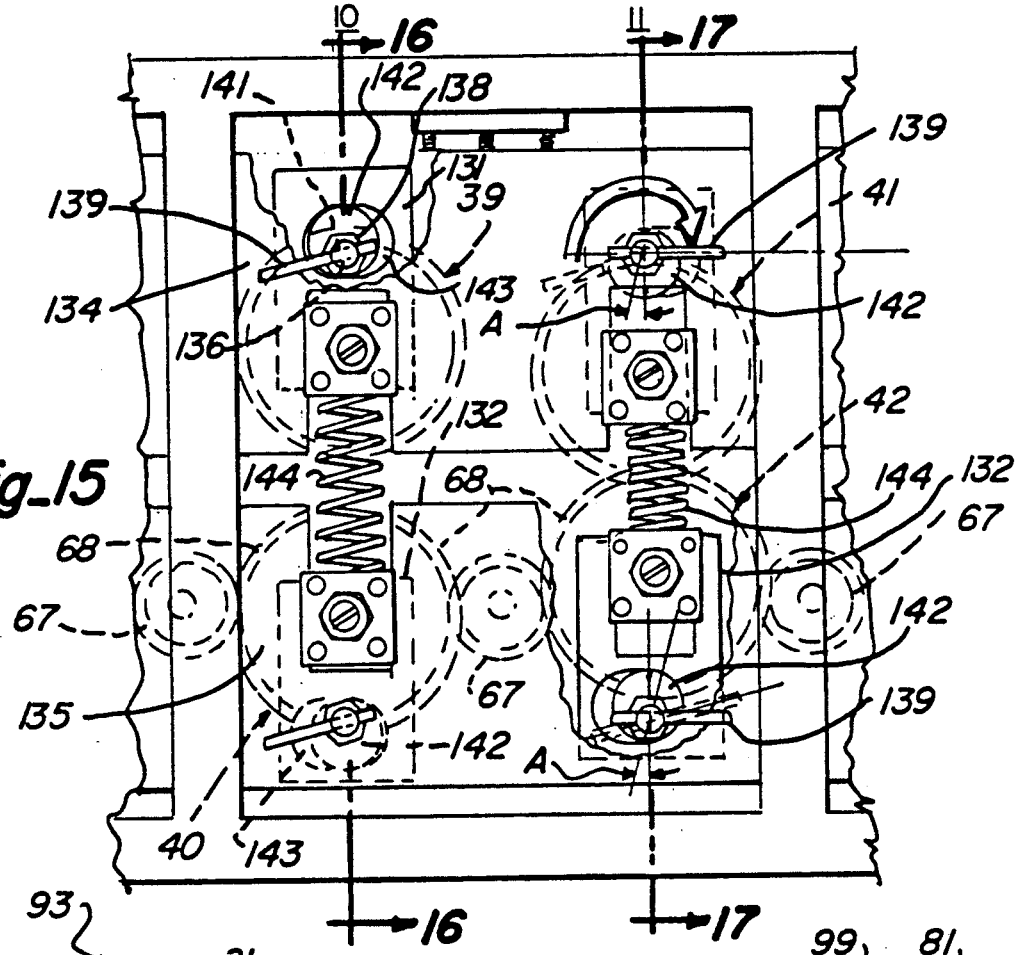
FIG. 15 is a sectional view taken along line 15—15 of FIG. 1 showing the right side at stations 11 and 12.

The drive train from stations 10 through 18 as shown in FIGS. 3 and 15 includes a larger gear 68 on each lower shaft that moves up and down therewith and a smaller idler gear 67 between and meshing with the adjacent larger gears 67. Gears 68 remain at the same vertical position. Gears 67 are on a common line midway between the upper and lower position for the lower shafts. This allows the lower rollers at stations 10–18 to continue to be driven from the gear motor whether in the up or down position as described more fully hereafter.

An adjustable entry guide assembly at the entry end 2 includes a front externally threaded transverse rod 71 at the entry end and a rear externally threaded transverse rod 72 downstream from rod 71. Each rod supports a left side guide 73 and a right side guide 74. Each guide has end surfaces and flat top and bottom surfaces between which the sheet material passes so as to be confined thereby so the sheet is confined both laterally and vertically. A nut 75 is provided on each side of a vertical portion of each guide. Each nut threads on the rod to lock the guide in place. The left side guides 73 are moved laterally to adjust for different widths of material.

Figure 4:
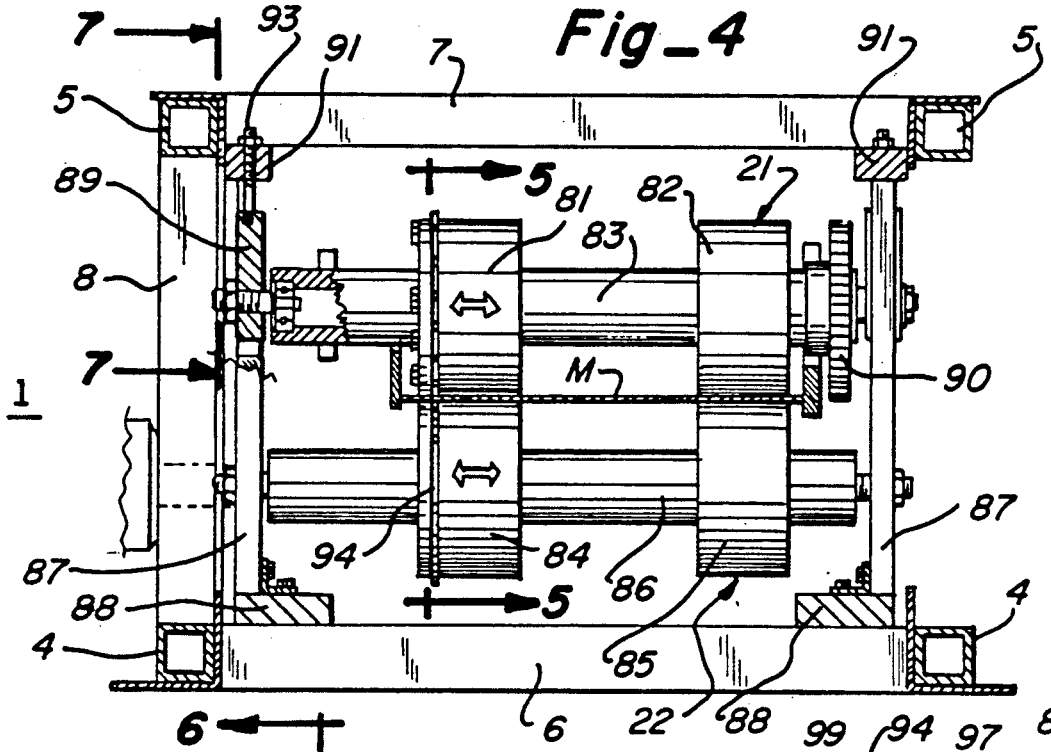
FIG. 4 is a sectional view taken along line 4—4 of FIG. 2 showing the feed or front end.
Figure 5:
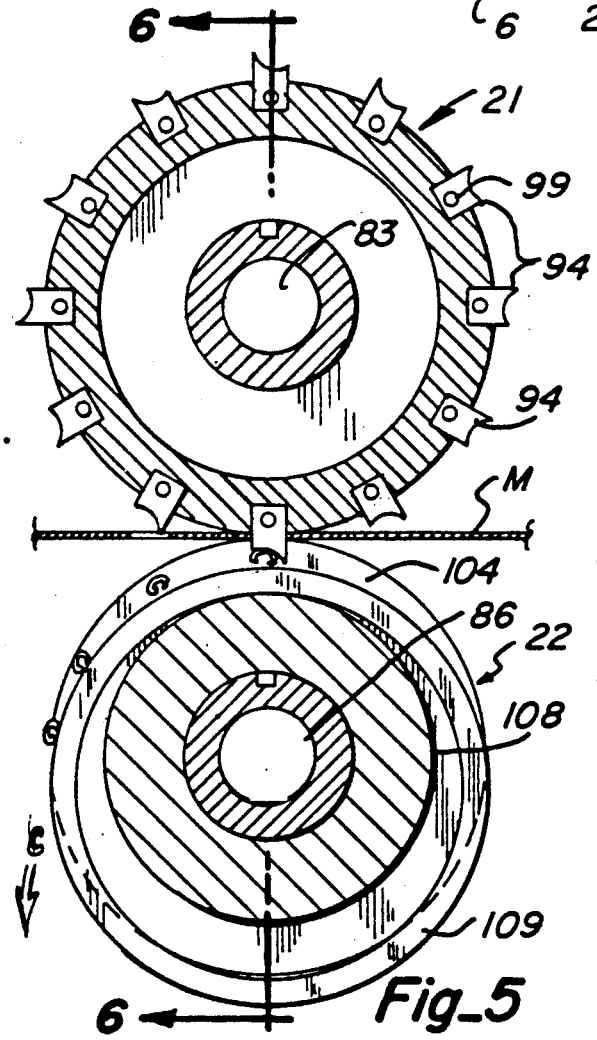
FIG. 5 is a sectional view taken along line 5—5 of FIG. 4.

Referring now to FIG. 4, at the first roller station 1 the upper roller 21 has an axially movable upper roller portion 81 and an axially fixed upper roller portion 82 on opposite sides of a midpoint between the ends of an upper support shaft 83. Roller portions 81 and 82 engage the top surface of the sheet material M.

The lower roller 22 has an axially movable lower roller portion 84 (opposite roller portion 81) and an axially fixed lower roller portion 85 (opposite upper portion 82) on opposite sides of a midpoint between the ends of a lower support shaft 86. Roller portions 84 and 85 engage the bottom surface of the sheet material M.

Figure 7:
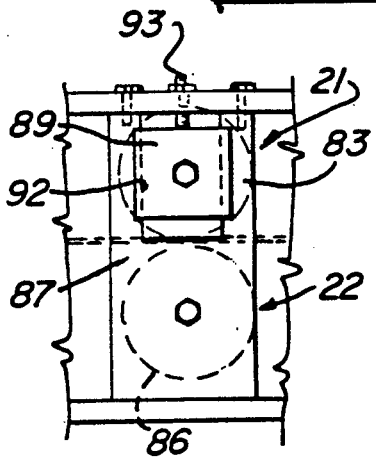
FIG. 7 is a sectional view taken along line 7—7 of FIG. 4.

The lower support shaft 86 is supported for rotary movement at the ends in a pair of laterally spaced side plates 87. As best seen in FIG. 4 the side plates 87 are supported upright on a pair of laterally spaced and longitudinally extending combination base and right angle bracket members 88 that are secured at the bottom to the bottom frame members 4 and at the top to a pair of laterally spaced and longitudinally extending top members 91 that fasten to the top frame 5. As seen in FIGS. 4 and 7 the upper support shaft 83 is in a slide plate 89 in a slot 92 in the side plate 87 that is moved up and down by an adjustment screw 93 to adjust for material thickness.

The upper roller 21 is not powered by the motor but is hand powered by having a gear 90 and a hand crank (not shown) with a gear that meshes with the gear 90 so that the material can be initially passed between the embossing rollers 23 and 24 before the drive motor is started. The lower roller 22 is an idler and is not power driven by the motor 58.

As best seen in FIGS. 4–9 a plurality of circumferentially spaced and radially extending punch blades 94 are mounted on upper roller portion 81 to produce punched out slugs 95 and form a series of holes or slots 96 in the sheet material M as it is moved between the upper and lower rollers 21 and 22 at station 1. The upper roller portion 81 has a notch 97 sized for receiving each blade 94, a plate 98 laps over the end of the upper roller portion 81 and a bolt 99 extends through the plate 98 and the blade, and threads into an internally threaded hole in the end of the upper roller portion 81.

Figure 8:
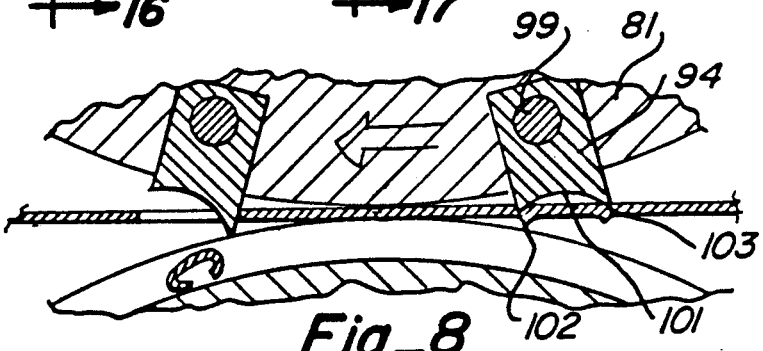
FIG. 8 is an enlarged sectional view similar to FIG. 5 showing the breaking through of the shear tooth on the punch blade.
Figure 9:
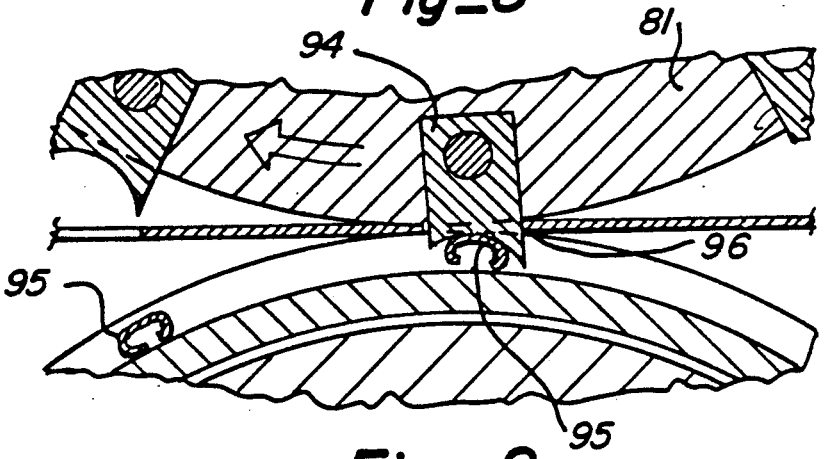
FIG. 9 is an enlarged sectional view similar to FIG. 8 after the shear tooth has completed forming a slot and the punched out slug.

Each punch blade 94 is of a generally rectangular shape with a curved surface 101 at one end forming two spaced shearing teeth or points 102 and 103. The leading tooth 102 is shorter than the trailing tooth 103 so they will engage the material at the same time as seen in FIG. 8.

Figure 25:
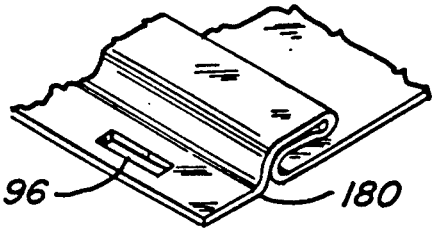
FIG. 25 is a fragmentary perspective view of an end portion of a one piece nail strip siding.
Figure 26:
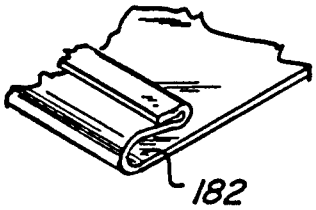
FIG. 26 is a fragmentary perspective view of an end portion of a one piece nail strip siding that requires separate fastening clips.
Figure 27:
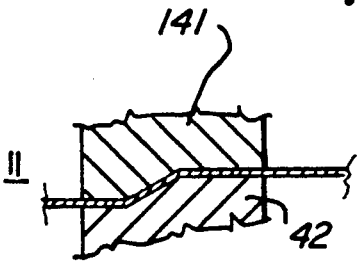
FIGS. 27-30 are fragmentary sectional views showing the peripheral shapes of a series of pairs of upper and lower rollers and associated siding at stations 11, 13, 15 and 17, respectively, for forming vertical board and batten siding and vertical double four and five siding shown in FIG. 35.
Figure 31:
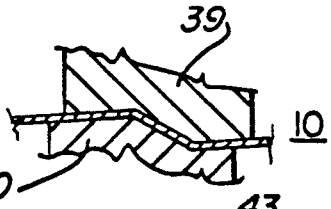
FIGS. 31-34 are fragmentary sectional views showing the peripheral shapes of pairs of upper and lower rollers and associated siding at stations 10, 12, 14 and 16, respectively, for forming horizontal double four and five siding.
Figure 28:
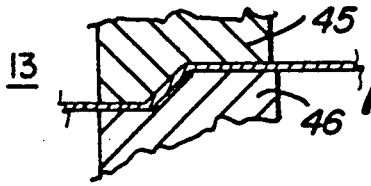
Figure 32:
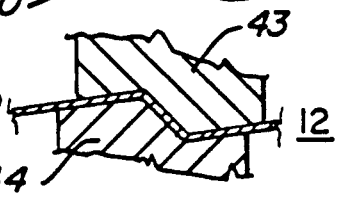
Figure 29:
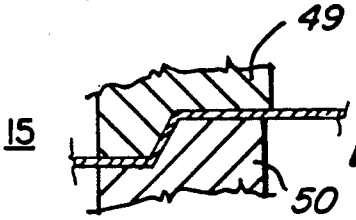
Figure 33:
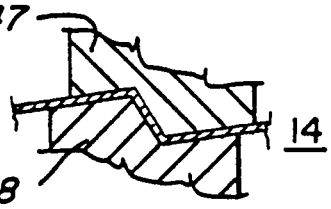
Figure 30:
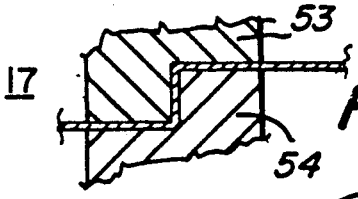
Figure 34:
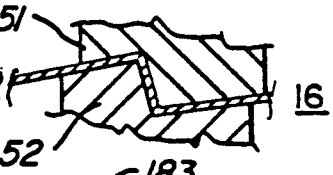
Figure 35:
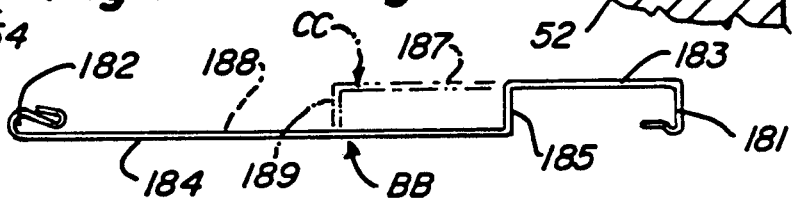
FIG. 35 is a cross-sectional view of the vertical board and batten siding and vertical double four and five siding shown in dashed lines formed by the roller pairs of FIGS. 27-30.

The lower roller portion 22 is provided with an annular slot 104 aligned and sized to slidably receive an outer end portion of each punch blade 94 in the punching operation. The slot 104 is provided by forming a notch or step 106 along the inside of an end ring 105 that is bolted to the end of roller portion 84 with a plurality of circumferentially spaced bolts 107. A slip ring 109 is supported in the slot. The slip ring has an external diameter approximately the same as the external diameter of the roller section 84 and an internal diameter considerably larger than the external diameter of the notch 106 forming a hub 108 so that the ring 109 will slide up and down in the slot 104 as the roller portion 84 rotates. This movement of the slip ring 109 moves the punched out slugs 95 away from the punch blades 94 and pushes the slugs out as the upper and lower rollers are rotated in synchronism to punch the series of slots or holes 96 in the sheet material M along the length thereof for the one piece nail strip siding (FIG. 25).

Figure 13:
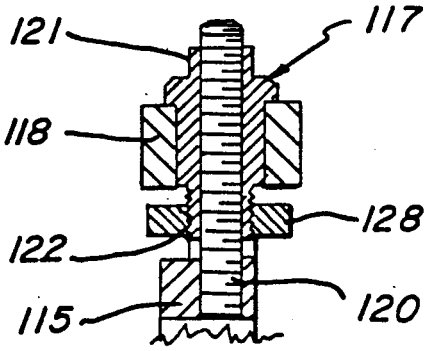
FIG. 13 is an enlarged cross-sectional view of the adjustment nut.

Referring now to FIGS. 10–14 the upper and lower rollers 23 and 24 at station 2 have patterns of mating depressions 112 and ridges 113 that extend generally lengthwise of the roller surface. These patterns in the top and bottom rollers form a wood-like grain in the material. The upper roller has a roller position adjustment arrangement for moving the upper roller 23 toward and away from the lower roller 24. This includes a pair of laterally spaced side plates 114 supporting the rollers at opposite ends. The upper roller is supported in a slide plate 115 that moves in a slot 116 in the side plate 114. An adjustment nut assembly 117 on a top bar 118 changes the position of the shaft according to the angular position of the nut assembly 117. A plurality of equally spaced and circumferentially arranged lines 119 are provided in the top bar 118 to indicate the angular position of assembly 117. As seen in FIG. 13 the nut assembly 117 includes an inner externally threaded bolt 120 having a lower end portion that threads into an internally threaded hole in the top of slide plate 115. An outer housing surrounds the upper portion of the bolt 120 which includes a top head portion 121 with spaced flat sides for engagement by a suitable wrench for turning the assembly 117 and a lower externally threaded portion 122 below the plate 118 on which a jam nut 128 is threaded. The jam nut must be loosened before rotating assembly 117. This enables the wood-like grain to be an optional feature in making the siding.

To accommodate the making of siding of two different widths which in the embodiment shown is 8 inch and 10 inch width siding, axially movable roller portions of both the upper and lower rollers of the first and third through ninth stations laterally adjust two inches. The roller shapes and siding shown are viewed from the entry end with the left side being to the left as viewed from the entry end and the right side to the right as viewed from the entry end. The positions or settings of the axially movable roller portions described herein are as viewed from the entry end. For stations 1 and 3 through 9 the first position is to the right and the second position is to the left. In the first position for stations 1 and 3–9 the 8 inch siding is formed and in the second position the 10 inch siding is formed.

Figure 6:
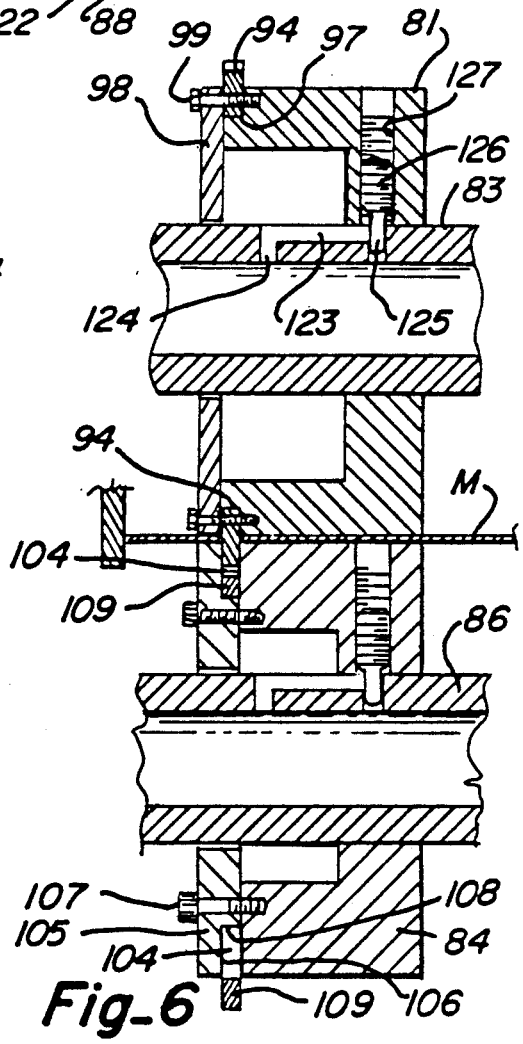
FIG. 6 is a sectional view taken along line 6—6 of FIG. 5.

The lateral roller adjustment for stations 1, 3–9 is of the type disclosed in the above-mentioned U.S. Pat. No. 4,899,566. Both of the upper and lower rollers of the first and third through ninth stations have the same adjustment. Referring now to FIG. 6 this adjustment includes an axial slot 123 in the upper shaft 83 with laterally spaced radial left and right holes 124 and 125, respectively, at each end of the slot in the movable roller portion 81. The width of the axial slot is only slightly greater than the end portion of the set bolt 126 to provide guided movement. The externally threaded set bolt 126 is threaded down into an internally threaded hole 127 in the movable roller portion to lock the axially movable roller portion 81 to the shaft and threaded up to release the movable roller portion for sliding, guided axial movement on the upper shaft 83.

Referring now to FIGS. 1 and 15 through 38, the last nine stations (10–18) have a lever-cam conversion system which is a roller position adjusting means which enables each upper and lower roller of each pair to be selectively spread apart to a non-shaping position or brought together to a closely-spaced shaping position according to which configuration or shape of siding is desired. While only the right side roller position adjusting means is shown in detail in FIGS. 15, 16 and 17 it is understood there is a similar and opposite left side roller position adjusting means that is of a similar construction and has the same operation so that a description of one applies to both. Further, while the embodiment shown and described herein is arranged to raise the upper roller and lower the lower roller for maximum spacing in the separated position it is understood that only either the upper or the lower could be raised or lowered to provide the necessary spacing in a non-shaping operation as is done with the embossing rollers previously described.

The position adjusting means for each of the rollers at stations 10–19 includes a pair of laterally spaced upper cam plates 131 that support the ends of the associated upper roller shaft for rotation and a pair of laterally spaced lower cam plates 132 that support the ends of the associated lower roller shaft for rotation. A pair of laterally spaced upper side members 134 are supported from the top of the frame and a pair of laterally spaced lower side members 135 are supported from the bottom of the frame.

A cam shaft 136 is supported for rotation in an aperture 137 in each side member. This cam shaft has a hex head 138 and an adjustment lever 139 extends transversely through an aperture 141 at the outer end of the cam shaft to enable the operator to manually rotate the cam shaft. The cam shaft has a cam lobe 142 on one end that rotates in an associated cam aperture 143. Aperture 143 is slightly larger than the diameter of the cam lobe and is elongated with two different centers to permit the cam lobe to rotate therein. The center of the cam lobe 142 is offset a selected distance from the center of the cam shaft 136 to provide the camming action and required vertical displacement. The cam lobe for the upper roller at station 10 is shown in the up position (disengaged) with the lobe being at a centered location and the adjustment lever 139 extending at a downwardly inclined angle toward the feed end. The cam lobe for the lower roller at station 10 is shown in the down position (disengaged) with the lobe being in a centered location and the adjustment lever 139 extending toward the feed end.

To change roller positions the cam lobe for the upper roller is rotated to a down position (engaged) as shown at station 11 by having the operator grasp lever 139 and rotate it in a clockwise direction approximating 195 degrees so that the lever 139 is horizontal and points toward the exit end. The cam lobe is rotated past center a selected angle A which in the embodiment shown is 16.7 degrees to cause the cam lobe to lock so that reverse pressure does not permit the rollers to separate during the shaping operation. Similarly, to change the lower roller position the cam lobe for the lower roller is rotated to an up position (engaged) as shown at station 11 by having the operator grasp lever 139 and rotate it in a clockwise direction approximating 195 degrees to a past center position at a selected angle A. A tension spring 144 is provided between blocks supporting the ends of the upper and lower roller shafts to provide a continuous push against the cam lobe in the over center position but this is optional.

Figure 16:
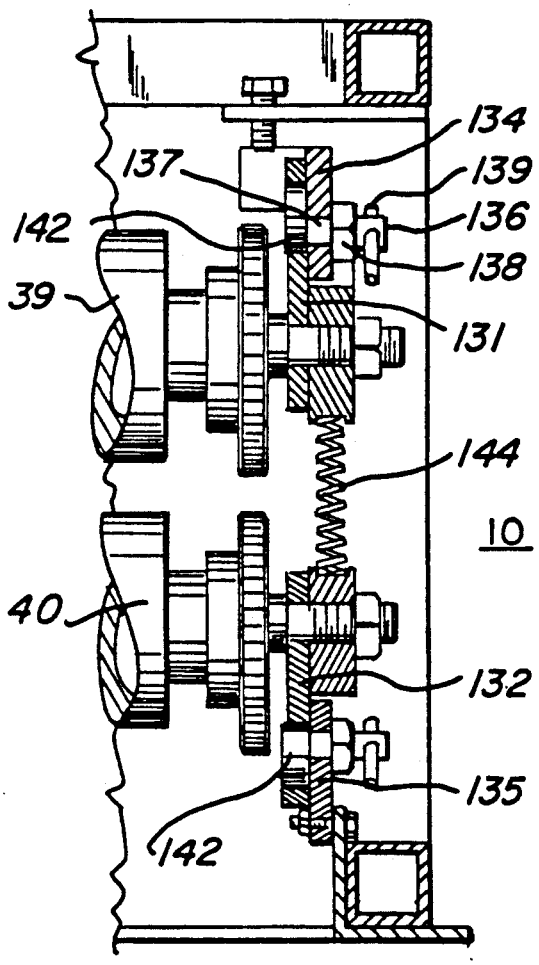
FIG. 16 is a sectional view taken along line 16—16 of FIG. 15 with the rollers in the spread non-shaping position.
Figure 17:
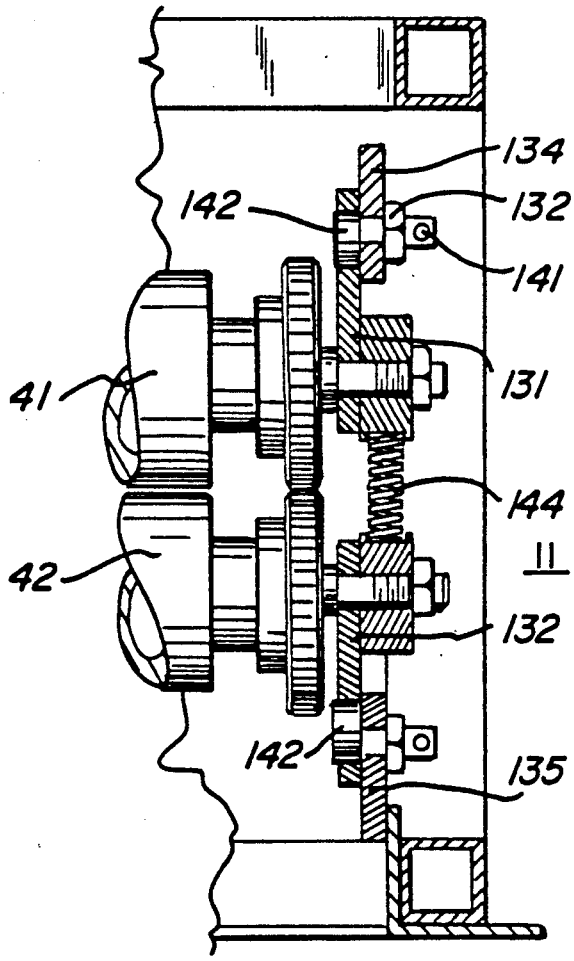
FIG. 17 is a sectional view taken along line 17—17 of FIG. 15 with the rollers in the shaping position.
Figure 18:
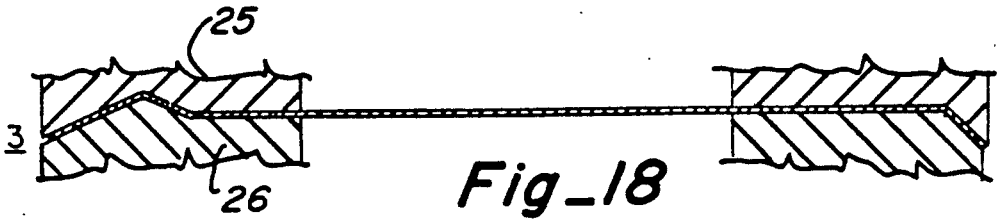
FIGS. 18-24 are fragmentary sectional views showing the peripheral shapes of the pairs of rollers and associated siding for stations 3 through 9, respectively, which form the edge flanges.
Figure 19:
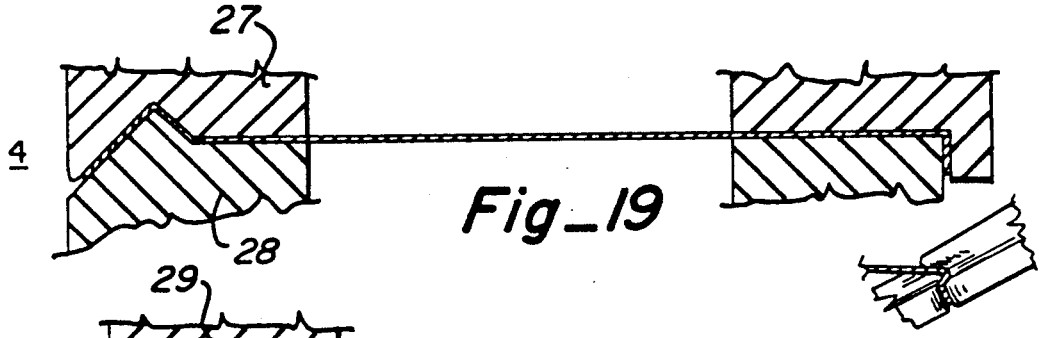
Figure 20:
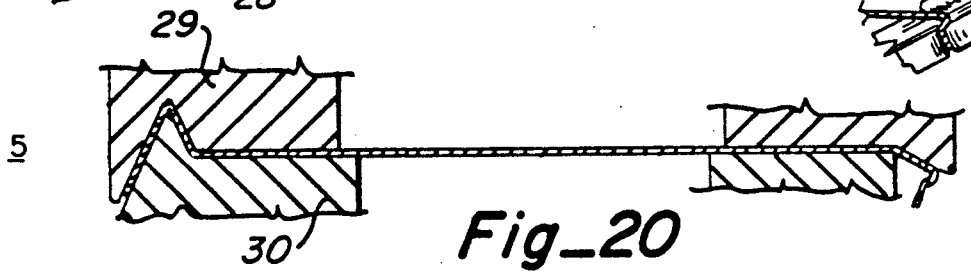
Figure 21:
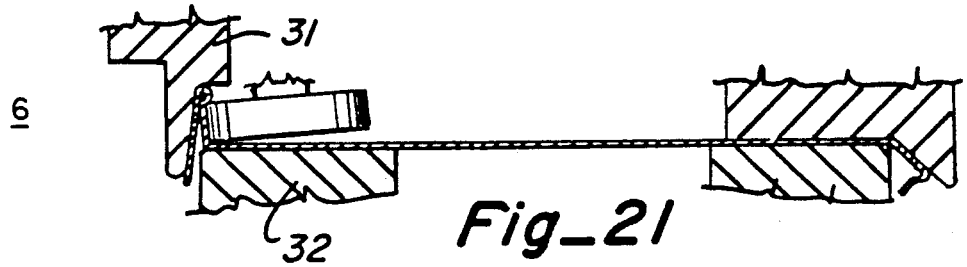
Figure 22:
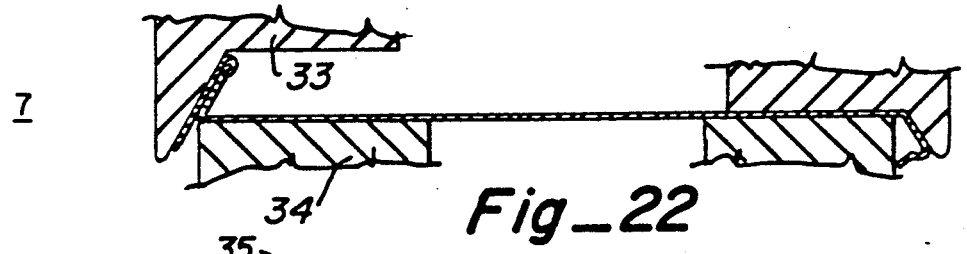
Figure 23:
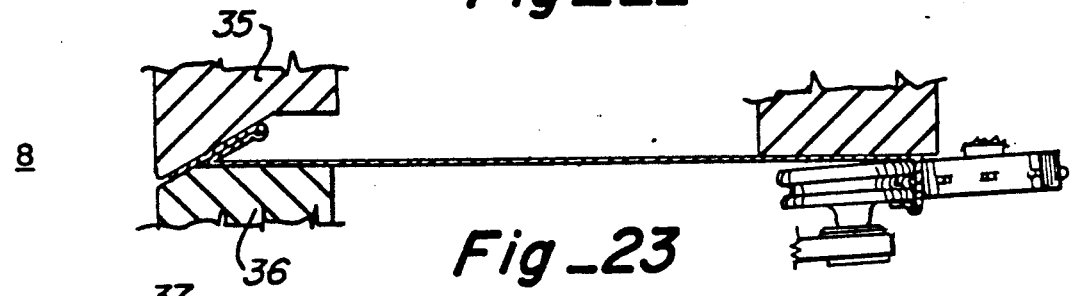
Figure 36:
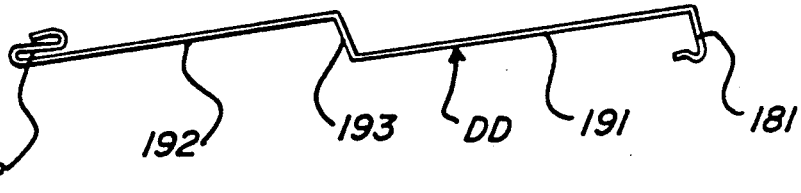
FIG. 36 is a cross-sectional view of horizontal double four siding formed by the roller pairs of FIGS. 31-34.

The series of four pairs of rollers at stations 10, 12, 14 and 16 have peripheral shapes (FIGS. 31–34) to successively form an eight inch horizontal double four siding or a ten inch horizontal double five siding designated DD (FIG. 36). Another series of four pairs of rollers (FIGS. 27–30) at stations 11, 13, 15 and 17 have peripheral shapes to successively form an eight or ten inch vertical board and batten siding designated BB or a vertical double four or five siding (commercial) designated CC shown in FIG. 35. Two upper and lower pairs of rollers of each of these two series of rollers are mounted on a pair of laterally spaced side members and with one pair always being in the shaping position while the other is in the retracted non-shaping position as shown in FIGS. 15 through 17. A third option is that both pairs are in the non-shaping position. In use, the operator will adjust each of the upper and lower cam shafts for each roller to set the cam lobe in either the up position or the down position depending on which siding shape is desired.

Figure 37:
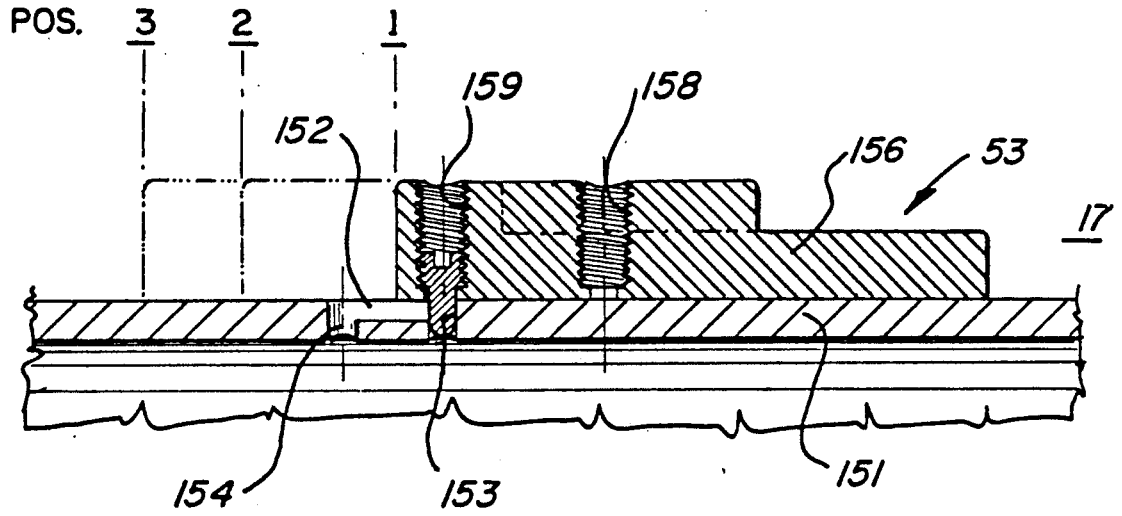
FIG. 37 is a cross-sectional view of a portion of the upper roller at station 17 illustrating the roller lateral adjustment with the movable roller portion for position 1 in full lines and positions 2 and 3 in dashed lines.

Both the upper and lower rollers at each of stations 10–19 have roller lateral adjustments. For stations 10, 12, 14 and 16 there is an adjustment between a right position and a left position similar to stations 1 and 2–9 above described. For stations 11, 13, 15 and 17 there is an adjustment between three positions. The upper roller at station 17 is typical and is shown in FIG. 37. The upper roller shaft 151 has an axial slot 152 with right and left radial holes 153 and 154 a selected distance apart at the ends of slot 152. The movable roller portion 156 also has right and left axially spaced internally threaded radial holes 158 and 159 that are a selected axial distance apart. When the left radial hole 159 of the movable roller portion is over the right radial hole 153 of the shaft, the upper roller is to the right position (Position 1). When the right radial hole 158 of the movable roller portion is over the right radial hole 153 of the shaft the roller portion is moved 2.5 inches to the left to an intermediate position (Position 2). When the right radial hole 158 of the movable roller portion 156 is over the left radial hole 154 of the shaft the movable roller portion is 1 inch further to the left to a left portion (Position 3).

Figure 38:
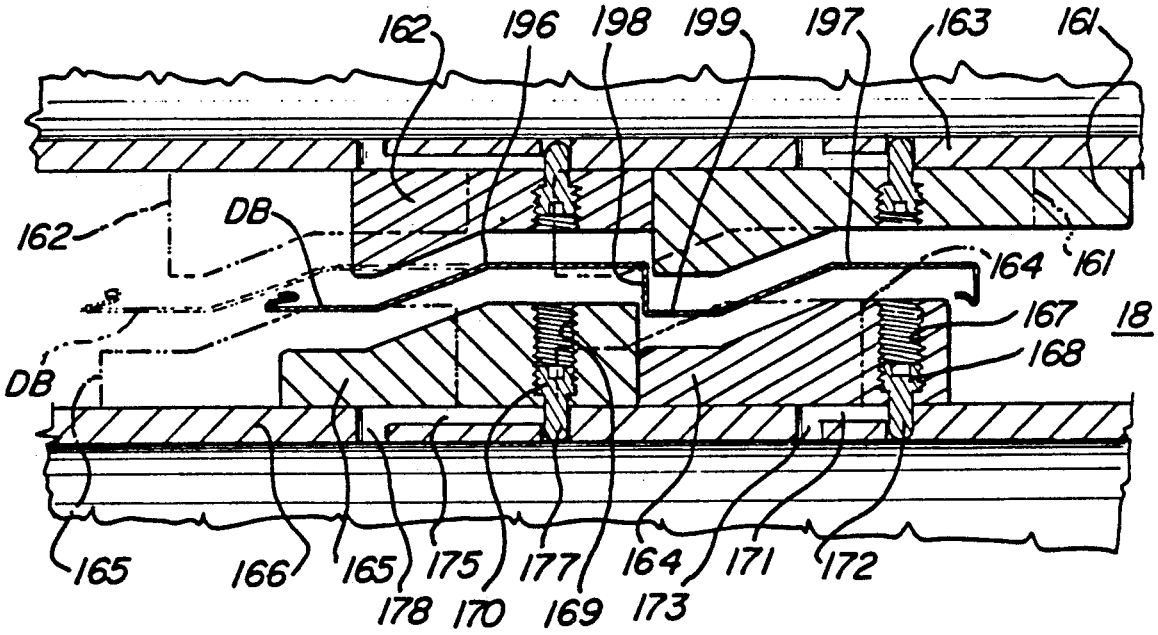
FIG. 38 is a cross-sectional view of a portion of the lower roller at station 18 illustrating the roller lateral adjustment with the movable roller portions to the right in full lines and the left position shown in dashed lines for forming dutch board siding.

For the roller lateral adjustment at station 18 there are two axially movable roller portions 161 and 162 on the upper shaft 163 and also two movable roller portions 164 and 165 on the lower shaft 166 as shown in FIG. 38. The adjustment for both top and bottom rollers is the same and referring to the bottom roller, movable roller portion 164 has an internally threaded hole 167 that receives a set screw 168. The movable roller portion 165 has an internally threaded hole 169 that receives a set screw 170. The lower shaft 166 has an axial slot 171 and two spaced radial holes 172 and 173 and the lower shaft also has an axial slot 175 and two spaced holes 177 and 178 similar to those above described for movement to one of two lateral positions. For the 8 inch dutch board siding DB the roller sections are set at the right position and for the 10 inch dutch board siding the roller portions are set at the left position.

Figure 24:
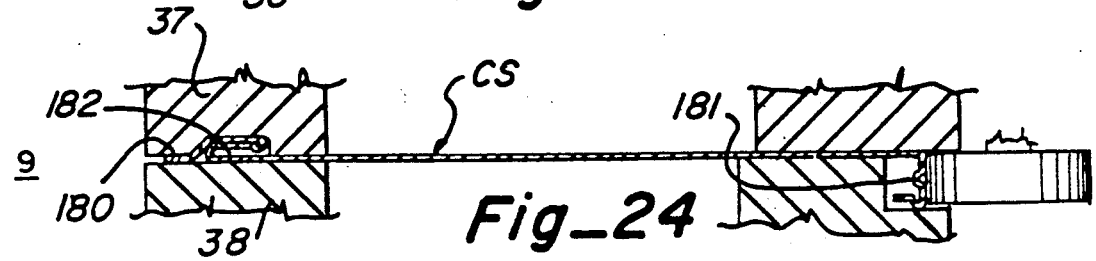

The colonial siding CS shown in FIG. 24 has edge fastening flanges along opposite side edges in the form of a generally channel-shaped butt flange 181 formed at one side edge and a hemmed hook flange 182 with a double edge thickness formed at the other edge with the face of the panel being flat. The one piece nail down strip has an extended flat section 180 that extends laterally out which is a result of using wider material. The board and batten siding BB has similar edge fastening members but has a shorter flat section 183 and a longer flat section 184 joined by an intermediate step 185 extending at right angles to the flat section. The commercial CC has two flat panel sections 187 and 188 of equal length joined by a right angle intermediate step 189. The horizontal double siding DD has two inclined panel sections 191 and 192 of equal length joined by an inclined intermediate step 193.

The dutch board siding DB shown in FIG. 38 has two panel portions 195 and 196 each with a flat section and an inclined section that are joined by a right angle intermediate step 198 and further has an intermediate flat section 199.

For forming flat siding seen in FIG. 24 at station 9 all of stations 10 through 18 have the upper and lower rollers moved to the spread position. For forming an 8 inch flat siding the movable roller portions of each of the pairs of upper and lower rollers at stations 1 and 3 through 9 are to the right position while for 10 inch they are at a left position.

For forming 8 inch vertical board and batten siding BB (FIG. 35) the movable roller portions at stations 1 and 3 through 9 are to the right and the movable roller sections at stations 11, 13, 15 and 17 are moved to the far right (Position 1) and each of the pairs of rollers at stations 11, 13, 15 and 17 are moved together to the shaping position.

For forming 10 inch vertical board and batten siding all of the movable roller portions at the stations 1 and 3 through 9 are moved to the left position with the remainder of the rollers at stations 10 to 18 staying the same as for the 8 inch vertical board and batten siding BB.

For forming 8 inch vertical double four siding CC (commercial) (FIG. 35 dashed) the movable roller portions of the first and third through ninth stations are moved to the right (8 inch position) and the movable roller portions at stations 11, 13, 15 and 17 move 2.5 inches to the left (Position 2) which is the center line of the 8 inch panel.

For 10 inch vertical double five siding CC (commercial) the movable roller portions at stations 1 and 3 through 9 are moved to the left position and the rollers at stations 11, 13, 15 and 17 are moved to the far left one inch (Position 3) which is the center line of a 10 inch panel.

For forming (commercial) horizontal double four siding DD as shown in FIG. 36 the rollers at stations 11, 13, 15 and 17 are moved apart to the spread position and each of the pairs of rollers at stations 10, 12, 14 and 16 are moved together to the shaping position. For forming the 8 inch horizontal double four panel the movable roller portions at stations 10, 12, 14 and 16 are at a right position which is centered on the 8 inch panel. For a 10 inch siding these movable roller portions at stations 10, 12, 14 and 16 are moved left one inch to a left position in which they are centered on the 10 inch panel (left position).

For forming 8 inch or 10 inch dutch board siding DB the double four or double five sidings above described are used and the movable roller portions at the final station 18 are moved to the shaping position so the dutch board panel is made by further shaping the horizontal double four pattern as seen in FIG. 36.

Although the present invention has been described with a certain degree of particularity, it is understood that the present disclosure has been made by way of example and that changes in details of structure may be made without departing from the spirit thereof.

What is claimed is:

1. In apparatus for making siding using a series of spaced stations each having upper and lower shaping rollers between which a sheet material is passed and including roller position adjusting means at selected of said stations, said roller position adjusting means comprising:

a pair of laterally spaced cam plates supporting a roller at opposite ends for rotation, and actuating means for moving said cam plates associated with said roller and said roller to either a shaping position or a non-shaping position, in said shaping position said roller is held against said sheet material to impart a selected shape to said sheet material, in said non-shaping position said roller is spaced from said sheet material, said actuating means including an inwardly extending cam shaft supported for rotation in a pair of laterally spaced side members disposed outwardly of said cam plates, each said cam shaft having a cam lobe disposed in a cam aperture in an adjacent of said cam plates so that rotation of each cam shaft moves the associated cam plate for moving the associated roller to said positions, each of said cam lobes move to a past center position to establish locking of the associated cam plate in said shaping position and including means resisting the movement of said cams from said past center position.

2. In apparatus as set forth in claim 1 wherein each cam shaft has a transverse actuating lever at an outer end to facilitate manual rotation thereof.

3. In apparatus as set forth in claim 1 wherein said upper side members support side plates that are vertically adjustable to vary the spacing between the associated upper and lower rollers to accommodate sheet material of different thicknesses.

4. In apparatus for making different siding using a series of spaced stations each having upper and lower shaping rollers between which the sheet material is passed and including roller position adjusting means at selected of said stations, said roller position adjusting means comprising:

a first series of said upper and lower rollers having a peripheral shape configured to impart a first selected shape to the material and a second series of said upper and lower rollers having peripheral shaped configured to impart a second selected shape to the material, a pair of laterally spaced upper cam plates and a pair of laterally spaced lower cam plates supporting associated upper and lower rollers at opposite ends for rotation, and actuating means for moving said cam plates associated with said roller and said supported upper and lower rollers to either a shaping position or a non-shaping position, in said shaping position said roller is held against said sheet material to impart a selected shape to said sheet material, in said non-shaping position said roller is spaced from said sheet material, said actuating means including an inwardly extending cam shaft supported for rotation in each of a pair of laterally spaced upper and lower side members disposed outwardly of associated of said cam plates, each said cam shaft having a cam lobe disposed in a cam aperture in an adjacent of said cam plates so that rotation of each cam shaft moves the associated cam plate for moving the associated roller between said positions for selectively forming different siding according to the angular positioning of said cam lobes, each of said cam lobes move to a past center position to establish locking of the associated cam plate in said shaping position and including means resisting the movement of said cams from said past center position.

5. In apparatus as set forth in claim 4 wherein each of said upper and lower rollers at selected of said stations have an axially movable roller portion on an associated shaft and having lateral adjustment means to enable movement of said axially movable roller portion to selected lateral positions on said shaft to provide for the forming of different siding shapes and different siding widths.

6. In apparatus as set forth in claim 5 wherein said first selected shape includes a pair of flat portions of different widths and an intermediate step portion transverse to said flat portions.

7. In apparatus as set forth in claim 5 wherein said first selected shape includes a pair of flat panel portions of the same width and an intermediate step portion transverse to said flat panel portions.

8. In apparatus as set forth in claim 5 wherein said second selected shape includes a pair of inclined panel portions of the same width and an intermediate step portion at an angle to said inclined panel portions.

9. In apparatus as set forth in claim 5 wherein said second selected shape includes a pair of panel portions and an intermediate step portion transverse to said panel portions and an intermediate flat section, each panel portion having a flat section and an inclined section.

10. In apparatus as set forth in claim 5 wherein said axially movable portions of said first series move between two different lateral positions.

11. In apparatus as set forth in claim 5 wherein said axially movable portions of said second series moves between three different lateral positions.

12. In apparatus as set forth in claim 5 wherein said lateral adjustment means includes an axial slot and a pair of radial holes at the ends of said slot in a shaft supporting the axially movable roller portion and a set screw in the associated roller portion.

13. In apparatus for making different siding from a sheet material, the combination comprising:

a series of pairs of opposed upper and lower rollers arranged at spaced intervals to provide roll-forming stations inside a frame with each roller being supported at opposite ends for rotary movement, drive means to rotate selected of said rollers, a first series of said pairs of upper and lower rollers being shaped to impart a first selected shape to the material, a second series of said pairs of upper and lower rollers shaped to impart a second shape to the material, first roller position adjusting means for moving said upper rollers and said lower rollers of each pair of said first series to either a shaping position or a non-shaping position, in said shaping position said pairs of rollers are held against said sheet material to impart a selected shape to said material, in said non-shaping position said pairs of rollers are separated to allow said sheet material to pass between said upper and lower rollers of said first series without altering said material, second roller position adjusting means for moving said upper rollers and said lower rollers of each pair of said second series to either a shaping position or a non-shaping position, in said shaping position said pairs of rollers are held against said sheet material to impart a selected shape to said material, in said non-shaping position said pairs of rollers are separated to allow said sheet material to pass between the rollers of said second group without altering said material, for selectively forming siding of different shapes according to the roller position setting of said pairs of rollers, said drive means including a lower gear on a shaft of each lower roller and an intermediate gear meshing with adjacent of said lower gears, said intermediate gears being disposed along a line between said shaping position and said non-shaping position of said lower rollers so that power is

14. In apparatus as set forth in claim 13 including a group of said rollers located upstream of said first and second series having peripheral shapes configured to impart fastening flanges along opposite side edges of said material.

15. In apparatus as set forth in claim 14 wherein said flanges are a channel-shaped butt and a hemmed hook.

16. In apparatus for making different siding from a sheet material, the combination comprising:

a series of pairs of opposed upper and lower rollers arranged at spaced intervals to provide roll-forming stations inside a frame with each roller being supported at opposite ends for rotary movement, drive means to rotate selected of said rollers, a first series of said pairs of upper and lower rollers being shaped to impart a first selected shape to the material, a second series of said pairs of upper and lower rollers shaped to impart a second shape to the material, first rollers position adjusting means for moving said upper rollers and said lower rollers of each pair of said first series to either a shaping position or a non-shaping position, in said shaping position said pairs of rollers are held against said sheet material to impart a selected shape to said material, in said non-shaping position said paris of rollers are separated to allow said sheet material to pass between said upper and lower rollers of said first series without altering said material, second roller position adjusting means for moving said upper rollers and said lower rollers of each pair of second series to either a shaping position or a separated position, in said shaping position said pairs of rollers are held against said sheet material to impart a selected shape to said material, in said non-shaping position said pairs of rollers are separated to allow said sheet material to pass between the rollers of said second group without altering said material, for selectively forming siding of different shapes according to the rollers position setting of said pairs of rollers, said drive means including a lower gear on a shaft of each lower roller and an intermediate gear meshing with adjacent of said lower gears, said intermediate gears being disposed along a line between said positions so that power is transmitted from one lower gear via said intermediate gear to the next lower gear when said lower gears are in either of said positions, one of said pairs of upper and lower rollers being in the form of an embossing station with rollers having mating ridges and depressions in the peripheral surfaces shaped to impart a wood-like grain to the material, and roller position adjusting means for moving said upper roller between a shaping position and a separated position which allows the material to pass between said rollers without altering said material, said roller position adjusting means including a pair of laterally spaced side members supporting said upper roller at opposite ends for rotation and means for moving said supported upper roller including an adjustment nut assembly threaded into each side member to change the position of the upper shaft according to selected angular settings of said adjustment nut assembly.

* * * * *